United States Patent [19]

Klar et al.

[11] Patent Number: 4,462,845

[45] Date of Patent: Jul. 31, 1984

[54] OXYGEN-FREE DISPERSION-STRENGTHENED COPPER AND PROCESS FOR MAKING SAME

[75] Inventors: Erhard Klar, Beachwood; Anil V. Nadkarni, Mentor; Prasanna K. Samal, Lyndhurst, all of Ohio

[73] Assignee: SCM Corporation, New York, N.Y.

[21] Appl. No.: 349,508

[22] Filed: Feb. 17, 1982

[51] Int. Cl.[3] ..... C21D 1/44

[52] U.S. Cl. ..... 148/13.2; 75/0.5 B; 75/0.5 BC

[58] Field of Search ..... 75/0.5 BC, 0.5 C, 0.5 B; 148/11.5 P, 11.5 C, 13.2

[56] References Cited

U.S. PATENT DOCUMENTS

| | | | |
|---|---|---|---|
| 3,179,515 | 4/1965 | Grant et al. | 75/206 |
| 3,352,667 | 11/1967 | Das et al. | 420/469 |
| 3,488,183 | 1/1970 | Schreiner et al. | 75/0.5 |
| 3,552,954 | 1/1971 | McDonald | 75/0.5 BC |
| 3,779,714 | 12/1975 | Nadkarni et al. | 75/0.5 BC |
| 3,884,676 | 5/1975 | Nadkarni et al. | 75/0.5 BC |
| 3,893,844 | 7/1975 | Nadkarni | 75/0.5 R |
| 4,045,644 | 8/1977 | Shafer | 219/119 |
| 4,077,816 | 3/1978 | Nadkarni | 419/19 |
| 4,110,130 | 8/1978 | Nadkarni | 148/11.5 P |
| 4,274,873 | 6/1981 | Nadkarni | 419/23 |
| 4,315,770 | 2/1982 | Nadkarni | 75/0.5 BC |
| 4,315,777 | 2/1982 | Nadkarni et al. | 419/19 |

*Primary Examiner*—John P. Sheehan

*Attorney, Agent, or Firm*—R. A. Sturges; M. H. Douthitt

[57] ABSTRACT

Substantially completely deoxidized, consolidated dispersion-strengthened copper stock of sizable cross section and particulates capable of being thus consolidated into such stock are shown. The stock exhibits ductility substantially greater than that of otherwise corresponding stock which contains about 100–500 ppm of available oxygen. Also shown is a staged powder deoxidation process using hydrogen or like reducing gas followed by the sequestration of remaining available oxygen with a minute proportion of diffusible, normally solid oxygen getter.

6 Claims, No Drawings

OXYGEN-FREE DISPERSION-STRENGTHENED COPPER AND PROCESS FOR MAKING SAME

This invention relates to powder metallurgy, and more particularly to substantially completely deoxidized dispersion-strengthened copper stock of sizable cross section, particulate dispersion-strengthened copper suitable for making same, and a process for producing such stock and such particulate.

BACKGROUND OF THE INVENTION

Presently dispersion-strengthened copper is manufactured in sizable quantity. The leading brand, made by SCM Corporation, is sold under the trademark GLIDCOP®. Because of its many valuable characteristics such copper now finds a variety of industrial uses. These include applications in resistance welding electrodes, electrical connectors, and transistor assemblies. Typically, the commercial product now contains approximately 200 ppm available oxygen. However, even this low-oxygen content impairs its utility for many electrical and electronic uses, bondings and brazing connections. U.S. patents and pending patent applications of that corporation which relate to the preparation and applications of dispersion-strengthened copper include: U.S. Pat Nos. 3,779,714; 3,884,676; 3,893,844; 4,045,644; 4,077,816; 4,110,130; and 4,274,873; Ser. No. 64,371 of Aug. 7, 1979 now U.S. Pat. No. 4,315,777 dated Feb. 16, 1982; and Ser. No. 146,140 of May 2, 1980 now U.S. Pat. No. 4,315,770 dated Feb. 16, 1982. The disclosure of all nine of these patents are incorporated herein expressly by reference.

Heretofore it has been proposed to deoxygenate a dispersion-strengthened copper part such as a strip by packing the part in elemental boron powder, then heating it at elevated temperature below the melting point of copper until the boron diffuses into the solid metal lattice, reacts with the residual oxygen therein, and substantially saturates the copper with elemental boron (U.S. Pat. No. 3,352,667). Resulting exemplary substantially completely deoxidized, dispersion-hardened strips were stated to resist hydrogen embrittlement. To conduct such deoxidation operation in a reasonable time clearly would require that the dispersion-strengthened copper part be quite small in cross section.

Advantages of the instant invention over such prior proposal include a better utilization of boron, the ability to use other oxygen getters effectively, improved process control, and the production of oxygen-free, dispersion-strengthened copper stock efficiently in larger cross sections than would be practical when following this prior teaching. Advantages of the instant product over present commercial dispersion-strengthened copper include its substantially better dutility, formability, and brazing properties.

BROAD STATEMENT OF THE INVENTION

One aspect of this invention is a substantially completely deoxidized, substantially fully dense consolidated-from-powder copper stock dispersion-strengthened with about 0.05–1% alumina calculated as elemental aluminum, said stock having sizable cross section and ductility that is substantially greater than that of otherwise corresponding stock which contains about 100–500 ppm of available oxygen.

Another aspect of this invention is substantially completely deoxidized dispersion-strengthened copper particles that are adapted to being consolidated into the immediately foregoing stock.

A further aspect of this invention is a process for producing deoxidized dispersion-strengthened copper which comprises subjecting particulate crude dispersion-strengthened copper to partial reduction with reducing gas having a dew point of about 0° to minus 50° F. at temperature not substantially in excess of about 1800° F. until the available oxygen content in said crude copper has been lowered to about 100 to 500 ppm, thereby providing a low-oxygen intermediate copper; and thermally inducing sequestration of substantially all of the remaining available oxygen in said intermediate copper with a minute proportion of diffusible oxygen getter at elevated temperature, said proportion being in excess of, but not substantially more than about double that which is stoichiometric for combining with all of the available oxygen remaining in said intermediate copper.

DETAILED DESCRIPTION OF THE INVENTION

Today a most practical process for manufacturing dispersion-strengthened copper is the process of internal oxidation. Feed for such process is copper-rich particles alloyed with a refractory oxide-providing metal, preferably aluminum (but also suitably silicon, titanium, zirconium thorium, magnesium, and the like). Advantageously, the concentration of refractory oxide-providing metal in the alloy is between about 0.1 and 1%; generally it is between about 0.05 and 0.7% for efficiency and economy, although such concentration can be much higher in some instances. The copper-rich alloy particles usually are atomized from the mixed metals in molten condition. Typically, an inert gas such as nitrogen is used to break up a molten stream, and the resulting powder is collected in water. Collected particles are dried and often are screened to remove a very small fraction of oversize material, e.g., that remaining on a 20-mesh (Tyler) screen. However, the entire atomizate or a fraction thereof can be rolled to flake larger particles, if desired. For best elevated temperature stress-rupture properties, especially where the alloy solute metal is present in a concentration of at least as much as about a third of a percent or more, it is advantageous to screen out ultrafines, e.g., those passing 400 mesh.

Oxidant for the internal oxidation process is cuprous oxide powder, typically one containing about 92–93% monovalent copper, some free copper, and some divalent copper. For efficiency it is advantageous to use pulverulent cuprous oxide having an average Fischer sieve size of about 5 microns, the actual sizes ranging between about 1 and 10 microns, although other various cuprous oxide powders and particles also can be used quite readily.

In most cases the proportion of oxidant ($Cu_2O$) used should be slightly in excess of that stoichiometrically needed for converting all of the refractory oxide-providing metal in the alloy particulates into refractory metal oxide, e.g., aluminum (Al) into alumina ($Al_2O_3$). Advantageously, for best product, the excess over stoichiometric is limited to about 60% and is maintained broadly in proportion to the content of alloyed refractory oxide-providing metal present, e.g., about 10–20% excess $Cu_2O$ for 0.2% Al and about 40–60% excess $Cu_2O$ for 0.6% Al.

A blend of the oxidant and alloy particles is heated to temperature of 1550°–1850° F. to decompose the oxidant, diffuse the resulting oxygen into the copper, and convert the refractory-providing material such as aluminum into refractory oxide that remains dispersed in the matrix metal (copper) phase. At this point, one can characterize the resulting dispersion-strengthened copper as a "crude" dispersion-strengthened copper, either a very friable, highly porous cake of particulates or free-flowing particulates. If such material is caked into a slightly coherent aggregate, it can be milled easily to break up the cake into discrete particles; otherwise, it can be used directly in the cake form for the partial deoxidation to follow. Both such caked and free-flowing particulates are to be considered "particulate" for the instant partial deoxidation process, although free-flowing particulates are preferred for handling and processing.

This crude material is the starting point for the instant process. First, it is partially reduced with a reducing gas such as hydrogen, dissociated ammonia, carbon monoxide, or a mixture of such reductants. Hydrogen-containing gas is preferred. The partial reduction is done at a temperature of about 1400°–1800° F. until the available oxygen in the copper (e.g., that from residual oxidant, but not that combined in the form of refractory particles) is not substantially above about 500 ppm and generally is about 200 ppm±100 ppm. Such deoxidation is about as far as it is generally possible or practical to attain in reasonable time (1 hour or less) using economic commercial gases which will have been supplied or can be dried to a dew point of at least about 0° F. and advantageously lower, e.g., minus 50° F. The partial reduction temperature should be well below the melting point of copper. Usually this will cause the powder mass to cake weakly, too.

Preparatory to the next deoxidation step the slightly coherent cake desirably is disintegrated into particles, e.g., using a hammer mill. This is imperative where the getter used is boron. The resulting disintegrated cake then can be blended intimately with a minute proportion of diffusible getter. The proportion of said getter should be slightly in excess of that which is stoichiometric for combining with and sequestering all of the available oxygen remaining in the low-oxygen intermediate copper. However, more than about double such stoichiometric proportion of getter is to be avoided, not only for economy, but also for obtaining and preserving the best properties in the resulting finished dispersion-strengthened copper product.

For ease of use the oxygen getter for the instant operation preferably will be in the form of fine, solid particulates. As getter diffuses at elevated temperature like boron to enter into the copper, or liberates a reductant such as hydrogen which will so diffuse, it effectively sequesters the remaining available oxygen. A preferred such getter for efficiency, and because it will not in minute amounts affect product properties adversely a great deal, is elemental boron. It will diffuse at a temperature of about 1500°–1750° F. into the copper lattice and do the necessary sequestration job. This and other getters that are not markedly hygroscopic, are reasonably stable in air at room temperature, and are not pyrophoric or have other dangerous property also can be useful alone or in mixtures with boron or each other. They are principally hydrides such as zirconium hydride, titanium hydride, magnesium hydride, calcium hydride, potassium borohydride, lithium aluminohydride, and sodium aluminohydride. Such hydrides decompose to liberate hydrogen and sequester the residual available oxygen. With such hydride materials, however, slight water and metalliferous residues result. If the metalliferous residue is oxidized or remains unalloyed with the copper, it usually can best be tolerated. Because appreciable amounts of getter residues detract from the properties of the end product, it is imperative that the proportion of any getter used should be very small as called for in this specification. Where water residue from the getter is highly diffuse in the resulting copper-rich particles, undesirable porosity and other bad effects usually are avoided. While a weakly agglomerated cake can be fully deoxidized satisfactorily with a hydrogen-releasing getter such as a hydride, it is advantageous to blend disintegrated cake with a getter powder in these instances also.

This ultimate deoxidation typically is carried out for about ½ to 4 hours and generally about 1–2 hours at 1500°–1750° F., and preferably at about 1650° F. in an inert atmosphere, suitably with the discrete copper particles or slightly agglomerated particles confined in a container, suitably one having virtually no available oxygen to waste getter. Where hydrogen is released, the container desirably is sealed to prevent air ingress but leak enough to preclude much pressure generation. A lower temperature and a longer time can be used where necessary to desirable; to sequester substantially all of the remaining oxygen and yield a dispersion-strengthened product with virtually no available oxygen left in it, a practical lower temperature for decomposition of a hydride getter is about 1200° F.

The resulting substantially completely deoxidized, dispersion-strengthened copper will be caked. The cake can be broken up into particles, e.g., in a hammer mill for eventual consolidation; alternatively the cake can be consolidated directly. Consolidation to fully dense stock, e.g., rod, strip, or billet can be done by a variety of methods. Advantageously, when such copper has been fully deoxidized in a metal container (such as can be made of virtually oxygen-free copper), the can can be evacuated, tightly sealed, and hot extruded at about 1600° F. to make a sizable rod or other shape of deoxidized dispersion-strengthened copper that has practically full density (that is, it has about 99% or more of full density).

Where the alumina content is about 0.05 to about 0.15% (calculated as elemental aluminum), the resulting copper-clad rod or other shape is especially useful for things such as incandescent lamp lead wire. Where the dispersion-strengthening alumina content is higher, e.g., 0.6% of alumina (calculated as elemental aluminum), it often is advantageous to use a steel, a stainless steel, or even a nickel container. Such product finds especially valuable use for making resistance welding electrode tips.

Other consolidating methods such as forging or swaging also are possible. The forging can be done in a confined die; the swaging can be done in a tube. With copper of higher refractory oxide content at least the final stages of swaging to achieve full density are done at an elevated temperature, e.g., 1600°–1800° F. Where the refractory content of the copper is low, e.g., 0.15% aluminum calculated as aluminum, deoxidized copper tubes can be used satisfactorily and the swaging can be done cold with intermediate sintering at about 1800° F. when consolidation is incomplete, e.g., at about 90% of full density.

The cross section of the consolidated part advantageously is at least about ⅛ to ¼ inch in thickness, and it can be substantially larger, e.g., a 3-to 6-inch diameter rod, or billet of such dimension.

Ductility of the resulting consolidated, substantially completely deoxidized dispersion-strengthened copper part thus made is outstanding. It generally is at least 25% greater than that of a corresponding stock piece consolidated from otherwise corresponding particles that have been partially deoxidized with hydrogen, dissociated ammonia, or the like and which still contain about 100–500 ppm, and typically 200 ppm, of available oxygen (as measured by a standard ASTM hydrogen loss test). Ductility can be measured by conventional rupture-stress testing and measuring the neck of the sample at rupture; the smaller, the neck, the more ductile.

Prime uses for the substantially completely deoxidized, consolidated-from-powder dispersion-strengthened copper stock of this invention include lamp leads, components for X-ray, microwave apparatus, and magnetrons, generally travelling wave tube helices, components of vacuum tubes and hydrogen-cooled electrical generators, semiconductor lead wires and frames, particularly those that need brazing, electric relay blades and contact supports and electric switch gear components in general, hemostatic surgical scalpels and other components where the dispersion-strengthened copper is bonded to high carbon steel, wire and strip electrical conductors generally, components of vacuum interrupters and circuit breakers, wide sheets or strips as for making shadow mats for TV tubes, and improved resistance welding electrodes and the like (which now are made from less completely deoxidized dispersion-strengthened copper), generally all for getting high temperature strength and improved stress-rupture qualities, non-blistering qualities, improved brazing quality, and improved mechanical properties for processing.

The following examples show how this invention has been tested, but should not be construed as limiting it. In this specification, all temperatures are in degrees Fahrenheit, all percentages are weight percentages, and all parts are parts by weight unless otherwise expressly indicated.

EXAMPLE 1

Internally oxidized, dispersion-strengthened copper powder containing about 0.15% alumina (measured as elemental aluminum) was the starting material. This powder was partially reduced in a belt-type furnace at a temperature of 1600° F. for one hour, using an atmosphere of dissociated ammonia. The resulting cake of partially deoxygenated copper was repowdered with a hammer mill. Available oxygen content of this powder was determined by a Hydrogen Loss Test (ASTM Test No. E 159) to be 0.02% (200 ppm).

Two hundred and fifty parts of the powder were filled into a substantially completely deoxidized copper cylinder measuring 8 inches in diameter×24 inches long, with a projecting fill tube measuring 1 inch in diameter and 8 inches in length. The copper cylinder was purged with argon while filling it with powder. The fill tube was closed (lightly sealed) by crimping. The powder-filled copper container was heated in a salt bath at a temperature of 1600° F. for 3 hours, then hot-extruded to make a 0.790" diameter, substantially fully dense (99+%) rod. This rod was then cold-drawn to 0.25-inch diameter rod, by taking a 25% reduction per pass. Samples of the latter rod were tested for mechanical properties, both in as-drawn condition and after annealing at 1200° F. The results are shown in Table I. Some of the 0.25-inch diameter rod was further cold-drawn to 0.080-inch diameter wire, taking a 25% reduction per pass.

The wire was tested for its resistance to hydrogen embrittlement, per ASTM Test No. F68-68, with the exception that a more severe annealing temperature of 1800° F. was used instead of 1560° F. as specified by the ASTM Test procedure. As required by such Test, the annealed wires were bend-tested over a 0.2-inch diameter mandrel. Two samples were tested. The number of bends these wires withstood before breaking were 9½ and 10, respectively. A sample of wire in the as-annealed (in hydrogen) condition was mounted for metallographic examination. The metallographic examination (50X magnification) of unetched specimen showed elongated cracks throughout the cross section of the specimen.

TABLE I

| | Yield Strength psi | Ultimate Tensile Strength (U.T.S.) psi | Elongation at Break, % | Reduction in Area at Break, % | Electrical Conductivity % (IACS*) |
|---|---|---|---|---|---|
| ¼" dia., as cold-drawn rod, - Sample 0.64" long - | 68,000 | 76,000 | 16 | 71 | 92 |
| ¼" dia., annealed at 1200° F. - 60 minutes, rod - Sample 0.64" long - | 63,000 | 68,000 | 20 | 74 | 92 |

*IACS (International Annealed Copper Standard).

EXAMPLE 2

Starting material like that of Example 1 was used in this test. It was partially reduced and repowdered as in Example 1, and had the same available oxygen content.

Two hundred and fifty parts of the powder were blended with 0.05 part of technically pure amorphous boron powder (about 1–2 micron size) for an hour. The resulting powder mix was then filled into a substantially completely deoxidized copper cylinder measuring 8 inches in diameter×24 inches long, with a fill-tube that was 1 inch in diameter and 8 inches in length. The copper cylinder was purged with argon while filling with powder. The filled cylinder was heat-treated at 1680° F. in nitrogen atmosphere for slightly longer than an hour. After the cylinder cooled down to room temperature, its fill tube was connected to a vacuum system, and entrapped gases were evacuated to a total pressure of 30 microns of mercury. At this point the fill tube was sealed by crimping. The sealed container was hot-extruded to 0.790-inch diameter, substantially fully dense rod. This rod was then cold-drawn to 0.25-inch diameter rod, taking a 25% reduction per pass. Samples of 0.25-inch diameter rod were tested for mechanical properties both in the as-drawn condition and after annealing at 1200° F. The results are shown in Table II. Some of the 0.25-inch diameter rod was further cold-drawn to 0.080-inch diameter wire, taking 25% reduction per pass.

The wire was tested for its resistance to hydrogen embrittlement in the same way as the corresponding wire of Example 1. The number of bends these wires withstood before breaking were 18 and 19, respectively. A sample of wire in the as-annealed (in hydrogen) condition was mounted for metallographic examination. The metallographic examination (50X) of un-etched specimen showed the material to be totally sound, i.e., free from any kind of cracks or pores, throughout its cross section.

TABLE II

| Sample | Yield Strength psi | Ultimate Tensile Strength (U.T.S.) psi | Elongation at Break, % | Reduction in Area at Break, % | Electrical Conductivity % (IACS*) |
|---|---|---|---|---|---|
| ¼" dia., as cold-drawn rod, - Sample 0.64" long - | 68,000 | 76,000 | 20 | 72 | 92 |
| ¼" dia., annealed at 1200° F. - 60 minutes, rod - Sample 0.64" long - | 63,000 | 68,000 | 25 | 78 | 93 |

*IACS (International Annealed Copper Standard).

EXAMPLE 3

Example 2 was repeated, except that the filled tube was hot extruded into a 1.50-inch diameter, substantially fully dense rod. Samples of this as-extruded rod were tested for mechanical properties. The results are shown in Tabe III. Samples of the as-extruded rod were also tested for its resistance to embrittlement by hydrogen. A 1.50-inch diameter×0.25-inch thick slice of the material was heated at 1800° F. in an atmosphere of pure hydrogen for 90 minutes, then cooled in hydrogen atmosphere. It showed no hydrogen embrittlement. Metallographic examination of this sample (50X) showed the material to be entirely sound, i.e., free from cracks and pores.

TABLE III

| Sample | Yield Strength psi | U.T.S. psi | Elongation at Break, % | Electrical Conductivity (IACS) % |
|---|---|---|---|---|
| 1.5" dia. as-extruded - Sample 2" long, milled to ¼" dia. - | 45,500 | 56,000 | 25 | 91 |

EXAMPLE 4

Example 1 was repeated except that the filled tube was hot extruded to a 3½-inch×¼-inch cross section strip coil. Samples of this as-extruded strip were tested for mechanical properties. The results are shown in Table IV. A sample of the as-extruded strip was also tested for its resistance to embrittlement by hydrogen. A 3.5-inch×0.25-inch×0.25-inch piece of the material was heated at 1800° F., in an atmosphere of pure hydrogen for 90 minutes, then cooled in hydrogen atmosphere. Metallographic examination of this sample showed the material to have elongated cracks throughout its cross section.

TABLE IV

| Sample | Yield Strength psi | U.T.S. psi | Elongation at Break % | Reduction in Area at Break, % | Electrical Conductivity % (IACS) |
|---|---|---|---|---|---|
| 3.5" × 0.25" strip, as-extruded - Sample 1" long, ¼" × 0.2" rectangle - | 43,000 | 51,000 | 24 | 65 | 90 |

EXAMPLE 5

Example 2 was repeated, except that the filled tube hot extruded to a 3½-inch×¼-inch cross section strip coil. Samples of this as-extruded strip were tested for mechanical properties. The results are shown in Table V. A sample of the as-extruded strip was also tested for its resistance to embrittlement by hydrogen. A 3.5-inch×0.25-inch×0.25-inch piece of the material was heated at 1800° F. in an atmosphere of pure hydrogen for 90 minutes, then cooled in hydrogen atmosphere. Metallographic examination of this sample (50X) showed the material to be entirely sound, i.e., free from cracks and pores.

TABLE V

| Sample | Yield Strength psi | U.T.S. psi | Elongation at Break % | Reduction in Area at Break % | Electrical Conductivity % (IACS) |
|---|---|---|---|---|---|
| 3.5" × .25" strip as-extruded-Sample 1" long × ¼" × 0.2" - | 54,000 | 63,500 | 26 | 68 | 90 |

EXAMPLE 6

Partially reduced powder like that of Example 2 was used. Ten parts of this powder were blended with 0.002 part of technically pure amorphous boron powder for one hour. The resulting powder mix was filled into a 1½" diameter, substantially completely deoxidized copper tube and cold-swaged into 0.5-inch diameter, substantially fully dense rod. The rod was sintered at 1700°–1800° F. for one hour in a nitrogen atmosphere. A sample of this rod was annealed in a pure hydrogen atmosphere at temperature of 1800° F. for 90 minutes to determine its resistance to hydrogen embrittlement. A metallographic examination of the tested sample (50X) showed the material to be entirely sound, i.e., free from cracks and pores. Some of the rod was cold drawn to 0.080-inch diameter wire, taking a 25% reduction per pass. Samples of the 0.080-inch diameter wire were tested for resistance to hydrogen embrittlement, using ASTM Test No. F-68-68, both at the ASTM specified temperature of 1560° F. and also using 1800° F. Concurrently with the above sample wire, samples of 0.080-inch diameter commercial O.F.H.C. grade copper wire were tested for comparison. As required by the test, the annealed wires were bend-tested over a 0.2" diameter mandrel. Two samples were tested from each kind of material. The results are shown in Table VI, below. The mechanical properties of the 0.080" wire made from the boronated copper of this example is shown in Table VII, following.

TABLE VI

| | Number of Bends to Failure | | | |
|---|---|---|---|---|
| | Annealed at 1560° F. | | Annealed at 1800° F. | |
| Sample | Test 1 | Test 2 | Test 1 | Test 2 |
| 0.080" wire boronated in this example, 10" long | 15 | 15 | 17 | 17 |
| OFHC Copper 0.080" wire, 10" long | 10 | 11 | 9 | 11 |

TABLE VII

| Sample | Yield Strength psi | U.T.S. psi | Elongation at Break % | Reduction Area at Break % | Electrical Conductivity %, IACS |
|---|---|---|---|---|---|
| 0.080" wire as drawn, boronated in this example, 10" long | 68,000 | 74,000 | 6 | 78 | 90 |
| 0.080" wire boronated in this example. Annealed at 1200° F. for 60 minutes, 10" long | 58,000 | 65,000 | 10 | 84 | 90 |

What is claimed is:

1. A process for producing deoxidized dispersion-strengthened copper which comprises:

subjecting particulate crude dispersion-strengthened copper to partial reduction at a temperature of 1400° F. to 1800° F. with a reducing gas having a dew point of about 0° to minus 50° F. until the available oxygen content in said crude copper has been lowered to about 100 to 500 ppm, thereby providing a low-oxygen intermediate copper; and thermally inducing sequestration of substantially all of the remaining available oxygen in said intermediate copper with a minute proportion of diffusible oxygen getter at elevated temperature, said proportion being in excess of, but not substantially more than about double that which is stoichiometric for combining with all of the available oxygen remaining in said intermediate copper.

2. The process of claim 1 wherein said crude copper and said intermediate copper are free-flowing particulates, and said getter is blended intimately with said intermediate copper for said sequestration.

3. The process of claim 1 wherein the substantially completely deoxidized dispersion-strengthened intermediate copper is consolidated to substantially full density.

4. The process of claim 3 wherein the consolidating is done by extrusion of the substantially completely deoxidized copper retained in a metal can, and said deoxidized copper contains about 0.05–0.15% alumina calculated as elemental aluminum.

5. The process of claim 1 wherein said intermediate copper contains about 100–300 ppm oxygen, the reducing gas used contains hydrogen, and the partial reduction therewith is done at temperature of about 1400°–1750° F.

6. The process of claim 1 wherein the getter is elemental boron powder in intimate admixture with free-flowing particulates of said intermediate copper and in a proportion of about 150% of said stoichiometric proportion to leave the resulting substantially completely deoxidized copper unsaturated with respect to elemental boron, and the sequestration is done at temperature of about 1500°–1700° F.

* * * * *